US011623854B2

(12) United States Patent
Clüsserath et al.

(10) Patent No.: US 11,623,854 B2
(45) Date of Patent: Apr. 11, 2023

(54) DEVICE AND METHOD FOR TREATING CONTAINERS FILLED WITH FOAMABLE LIQUID FILLING MATERIAL

(71) Applicant: KHS GmbH, Dortmund (DE)

(72) Inventors: Ludwig Clüsserath, Bad Kreuznach (DE); Achim Kunz, Simmern (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 17/050,993

(22) PCT Filed: May 15, 2019

(86) PCT No.: PCT/EP2019/062468
§ 371 (c)(1),
(2) Date: Oct. 27, 2020

(87) PCT Pub. No.: WO2019/233717
PCT Pub. Date: Dec. 12, 2019

(65) Prior Publication Data

US 2021/0229971 A1 Jul. 29, 2021

(30) Foreign Application Priority Data

Jun. 6, 2018 (DE) ..... 102018113435.5

(51) Int. Cl.
*B67C 3/22* (2006.01)
*B67C 3/00* (2006.01)
*B67C 7/00* (2006.01)

(52) U.S. Cl.
CPC ..... *B67C 3/222* (2013.01); *B67C 3/007* (2013.01); *B67C 7/004* (2013.01)

(58) Field of Classification Search
CPC .. B67C 3/00; B67C 3/007; B67C 3/22; B67C 3/222; B67C 7/004
USPC ..... 53/432
See application file for complete search history.

(56) References Cited

U.S. PATENT DOCUMENTS

2014/0043421 A1* 2/2014 Lindner ..... B41J 3/4075 347/106

FOREIGN PATENT DOCUMENTS

| | | | | |
|---|---|---|---|---|
| CN | 103476679 A | 12/2013 | | |
| CN | 103771313 A | 5/2014 | | |
| DE | 4030081 A1 | 3/1992 | | |
| DE | 4343750 A1 | 9/1994 | | |
| DE | 102004054859 A1 | 5/2006 | | |
| DE | 102008006770 A1 | 8/2009 | | |
| DE | 102008032822 A1 * | 1/2010 | ..... | B67C 3/222 |
| DE | 102008032822 A1 * | 1/2010 | ..... | B67C 3/222 |
| DE | 102008032822 A1 | 1/2010 | | |

(Continued)

OTHER PUBLICATIONS

International Search Report and English Translation dated Aug. 27, 2109 in PCT Application No. PCT/EP2019/062468.

*Primary Examiner* — Andrew M Tecco
*Assistant Examiner* — Jacob A Smith
(74) *Attorney, Agent, or Firm* — Occhiuti & Rohlicek LLP

(57) ABSTRACT

A container-treatment machine includes a foaming unit that introduces foaming medium into a container that is filled with a foamable liquid. This causes a foam to form in the container. A sensor downstream obtains an image of the foam and provides it to a controller. The controller decides whether or not to eject the container based on the extent of a foam nose that forms on the container's outer surface.

18 Claims, 4 Drawing Sheets

(56) References Cited

FOREIGN PATENT DOCUMENTS

| | | | | | |
|---|---|---|---|---|---|
| WO | 0135060 | A1 | | 5/2001 | |
| WO | WO-2009095054 | A1 | * | 8/2009 | ..... B67C 3/222 |

* cited by examiner

DEVICE AND METHOD FOR TREATING CONTAINERS FILLED WITH FOAMABLE LIQUID FILLING MATERIAL

RELATED APPLICATIONS

This is the national-stage entry of PCT/EP2019/062468, filed on May 15, 2019, which claims the benefit of the Jun. 6, 2018 priority date of German application DE 102018113435.5, the contents of which are incorporated herein by reference.

FIELD OF INVENTION

The invention relates to treatment of a filled container, and in particular, to treating a container filled with a foamable liquid.

BACKGROUND

Bottles and cans typically have a space between the surface of the liquid and the cap or lid. This space, referred to as a head space, is filled with gas. Since oxygen is reactive, the presence of oxygen in this gas may impair the liquid's quality. It is therefore desirable to remove oxygen from this space before closing the container.

SUMMARY

According to a first aspect, the invention relates to a device for treating containers filled with foamable liquid filling material, such as bottles, cans, or the like. The device comprises, arranged along a transport segment, a foaming unit, a closing unit following in a transport direction along the transport segment, and a screening ejection unit following in turn long the transport segment.

Preferably, the foaming unit provided on the transport segment of the filled but not yet closed containers is configured so as to introduce a foaming medium into the containers which will have the effect of foaming.

Other embodiments of a foaming unit cause foaming in other ways, for example, by shaking and/or moving the container, and/or by the effect of a laser beam. These all have the property of introducing energy into the material to cause foaming thereof.

In addition to this, the device further comprises at least one first optoelectrical sensor unit of a monitoring unit, downstream of the foaming unit in the transport direction of the transport segment, wherein, with the at least one first sensor unit of the monitoring unit, the foam formation of the containers and/or the fill level of liquid filling material in the container, during and/or after the closing, can be monitored on the basis of at least one first monitoring criterion. In this situation, the at least one first optoelectrical sensor unit and the monitoring unit are configured for monitoring the foam formation and/or the fill level of liquid filling material in the container on a container outer wall, during and/or after the filling of the containers. In particular, the ejection station is configured so as to eject such containers which, in respect of the foam formation, lie outside a target range of the at least one first monitoring criterion, which is initiated by a signal generated by the monitoring unit.

In some embodiments, provision can be made for the at least one first optoelectrical sensor unit for detecting and monitoring the foam formation of the containers and/or the fill level of liquid filling material in the respective container to be located immediately before the placement and/or pressing of a container closure in the closing station and/or shortly after the actual closing process of the container closure, on the basis of the at least one first monitoring criterion.

In some embodiments, provision can be made for the at least one first optoelectrical sensor unit for detecting and monitoring the size of the foam formation, emerging over the mouth edge of a container mouth of a container, settling at a container outer wall in the form of a foam nose, to be configured as a first monitoring criterion.

In some embodiments, provision can be made for the image-processing and control device to be configured so as to compare the at least one first monitoring criterion, detected by the at least one first optoelectrical sensor unit, as an actual value, with target values deposited in the image-processing and control device, and then delivering a signal to the ejection station if the actual value determined falls short or exceeds the deposited target value.

In some embodiments, provision can be made for the at least one first monitoring criterion to include the size of the foam formation emerging over the mouth edge of a container mouth of a container, settling at a container outer wall in the form of a foam nose, with the incorporation of its thickness.

In some embodiments, provision can be made for the device further to comprise at least one second optoelectrical sensor unit of the image-processing and control device, arranged in the transport direction of the transport segment between the foaming unit and the first optoelectrical sensor unit, wherein the at least one second optoelectrical sensor unit of the image-processing and control device is configured for the detecting and controlling of the foam formation of the containers before closure, on the basis of at least one second monitoring criterion, wherein the at least one second optoelectrical sensor unit and the image-processing and control device are configured for monitoring and controlling the foam formation above the container opening with containers which are not yet closed, and wherein, by means of the foaming unit, on the basis of a signal produced by the image-processing and control device, a change can be caused in the energy input of a jet of the foaming unit.

In some embodiments, provision can be made for the at least one second optoelectrical sensor unit and the image-processing and control device for the detection and monitoring of the foam formation above the opening edge of the respective container mouth to be configured as a second monitoring criterion.

In some embodiments, provision can be made for the energy input of the foaming medium, in particular the pressure of the jet and/or the quantity of the foaming medium introduced into each container and/or the intensity of the shaking or movement of the container and/or the intensity of a laser beam to be controlled, as a dependency of the image data provided by the at least one second optoelectrical sensor unit, in such a way that whenever an inadequate foam formation is detected in a container, controlled by the image-processing and control device, the energy input of the foaming medium into the following container is increased, and/or, conversely, this energy input for the following containers is reduced if an excessive over-foaming effect is detected at a container.

The expression "essentially" or "approximately" signifies in the meaning of the invention deviations from the respective exact value by +/−10%, preferably by +/−5%, and/or in the form of changes which are not of significance for the function.

Further embodiments, advantages, and possible applications of the invention also derive from the following description of exemplary embodiments and from the Figures. In this context, all the features described and/or represented as images are, independently or in any desired combination, in principle the object of the invention, regardless of their summary in the claims or reference to them. The contents of the claims are also deemed to be constituent parts of the description.

Although some aspects have been described in connection with a device, it is understood that these aspects also represent a description of the corresponding method, such that a block element or a structural element of a device is also to be regarded as a corresponding method step or as a feature of a method step. By analogy with this, aspects which have been described in connection with a method step or as a method step represent a description of a corresponding block or of a detail or of a feature of a corresponding device. Some or all of the method steps can be carried out by a hardware apparatus (or with the use of a hardware apparatus), such as, for example, a microprocessor, a programmable computer, or an electronic circuit. With some exemplary embodiments, some or a plurality of the most important method steps can be carried out by such an apparatus.

BRIEF DESCRIPTION OF THE DRAWINGS

The invention is explained in greater detail hereinafter on the basis of the Figures in connection with exemplary embodiments. The Figures show.

Identical reference numbers are used in the Figures for elements of the invention which are the same or have the same effect. Further, for the sake of easier overview, only reference numbers are represented in the individual Figures which are required for the description of the respective Figure.

DETAILED DESCRIPTION

Figure 1:
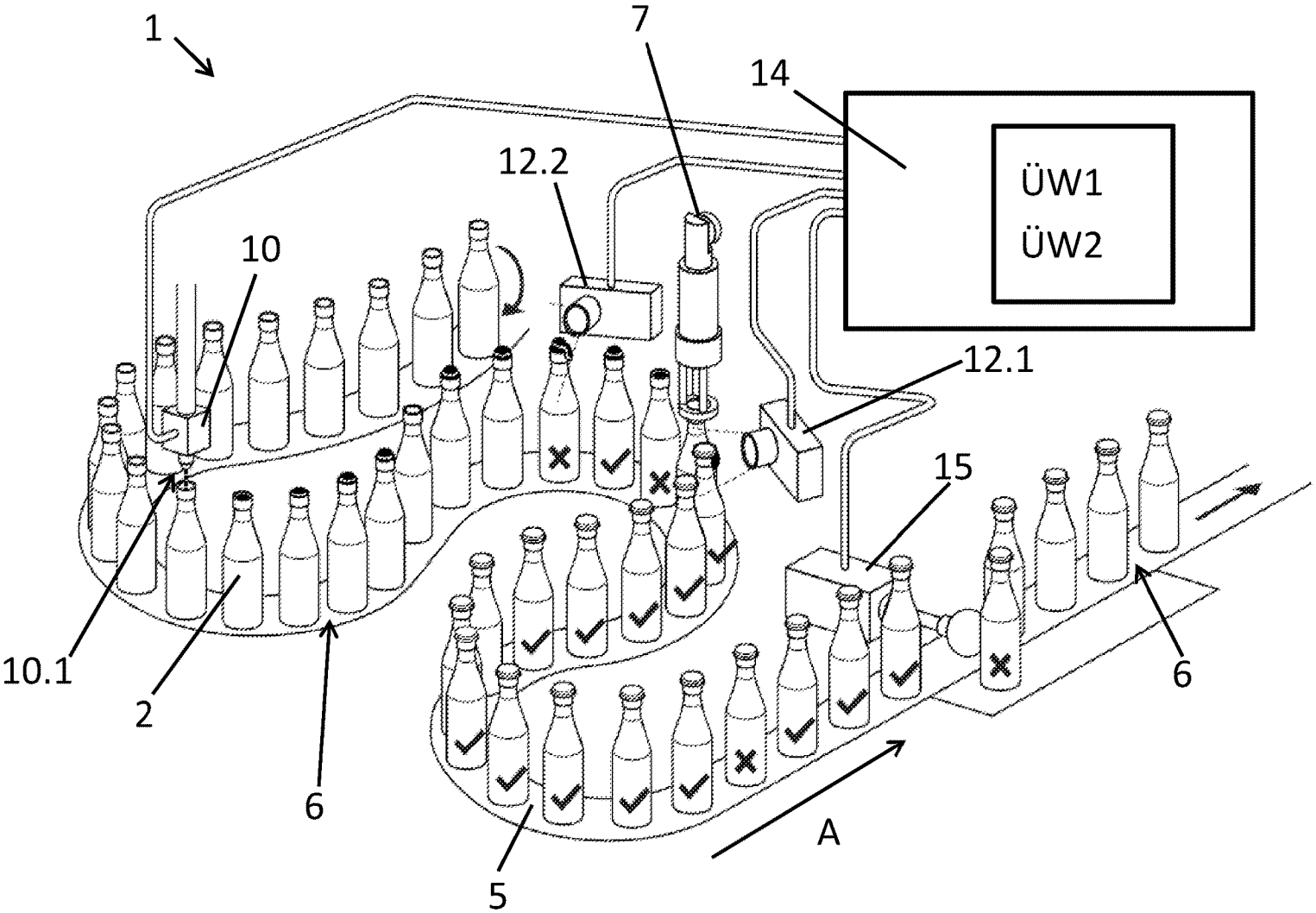
FIG. 1 shows a side view of a device for treating containers filled with a foamable liquid.

FIG. 1 shows an apparatus for treating containers 2 that have been filled with a foamable liquid. Examples of such containers include bottles and cans. The apparatus shown is typically a constituent of a filling machine or arranged downstream of a filling machine along a transport direction A.

The illustrated apparatus includes a foaming unit 10 along a transport segment 6, a closing station 7 that follows in the transport direction A, and an ejection station 15 that follows the closing station 7 along the transport segment 6 and in the transport direction A.

A suitable filling machine for filling containers 2 is a rotating filling machine in which a rotor rotates about a vertical machine axis. The rotor's circumference includes filling positions, each of which receives a container 2 to be filled.

A transport star typically brings the containers 2 that are to be filled. A transporter 5 removes containers 2 that have been filled with foamable liquid from the rotor and conveys them in the transport direction along the transport segment 6. In some embodiments, the transporter 5 is a chain conveyor or belt conveyor that conveys upright standing containers 2.

The containers 2 continue along the transport segment 6 to a closing station 7. The closing station 7 closes a container's mouth 2.1 with a suitable closure, such as a crown cork. The container 2, now filled and closed, continues to travel in the transport direction A along the transport segment 6 to another devices, such as a labelling machine.

Oxygen present in the container's headspace can impair the liquid in the container. Such oxygen is present in the head space, just above the liquid's surface in the filled container 2. To avoid this, it is useful to introduce a narrow jet of foaming medium 10.1 at the foaming unit 10 after filling has been completed. A suitable foaming medium 10.1 is sterile water.

The foaming unit 10 includes a nozzle or nozzle arrangement. The nozzles introduce a thin jet 10.1 of the foaming medium. The kinetic energy in this jet 10.1 tends to release carbon dioxide from the liquid. This causes foaming above the liquid's level, thus displacing oxygen-containing air and replacing it with carbon dioxide.

The extent to which foaming occurs depends on the filling material's properties, such as its viscosity. It also depends on its temperature, its carbon dioxide content, on the foaming medium's temperature, and on the kinetic energy carried by the foaming medium. This kinetic energy depends on volume flow and pressure of the foaming medium as it impacts the liquid filling material in the container 2.

The goal of the foaming process is to produce the correct amount and type of foam. The foam must be sufficient to expel all the air. It must be as compact as possible with a minimum of contrast differences.

Figures 2A, 2B, 2C:
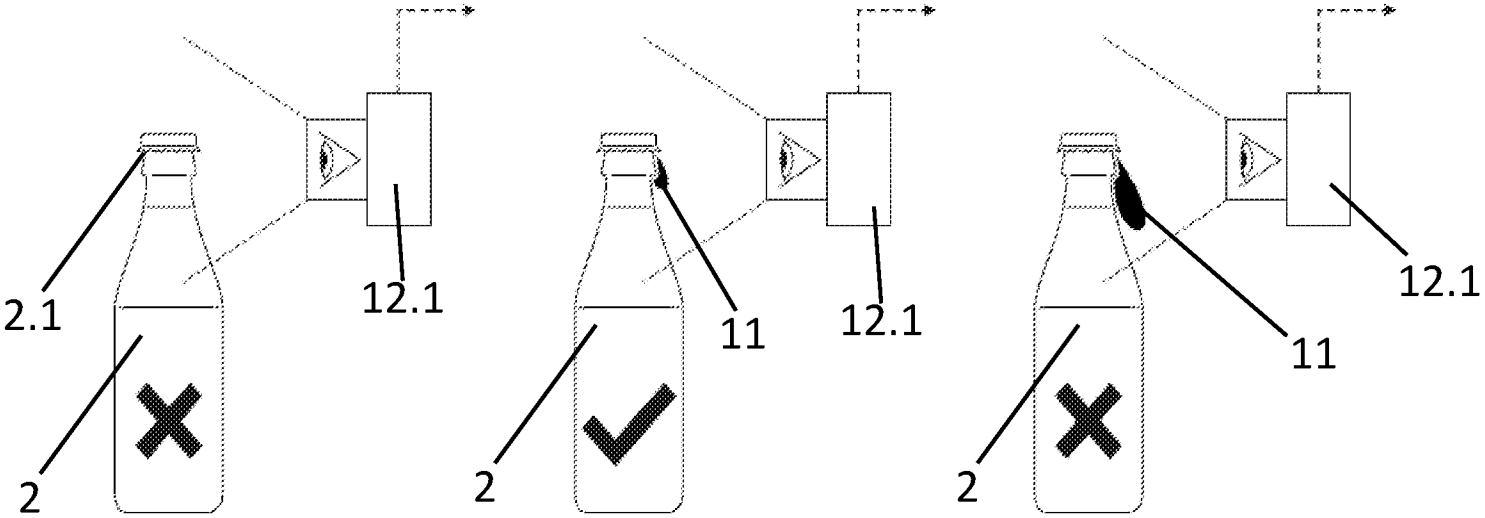
FIGS. 2*a*-2*c* show containers with different levels of foam formation.
Figure 3:
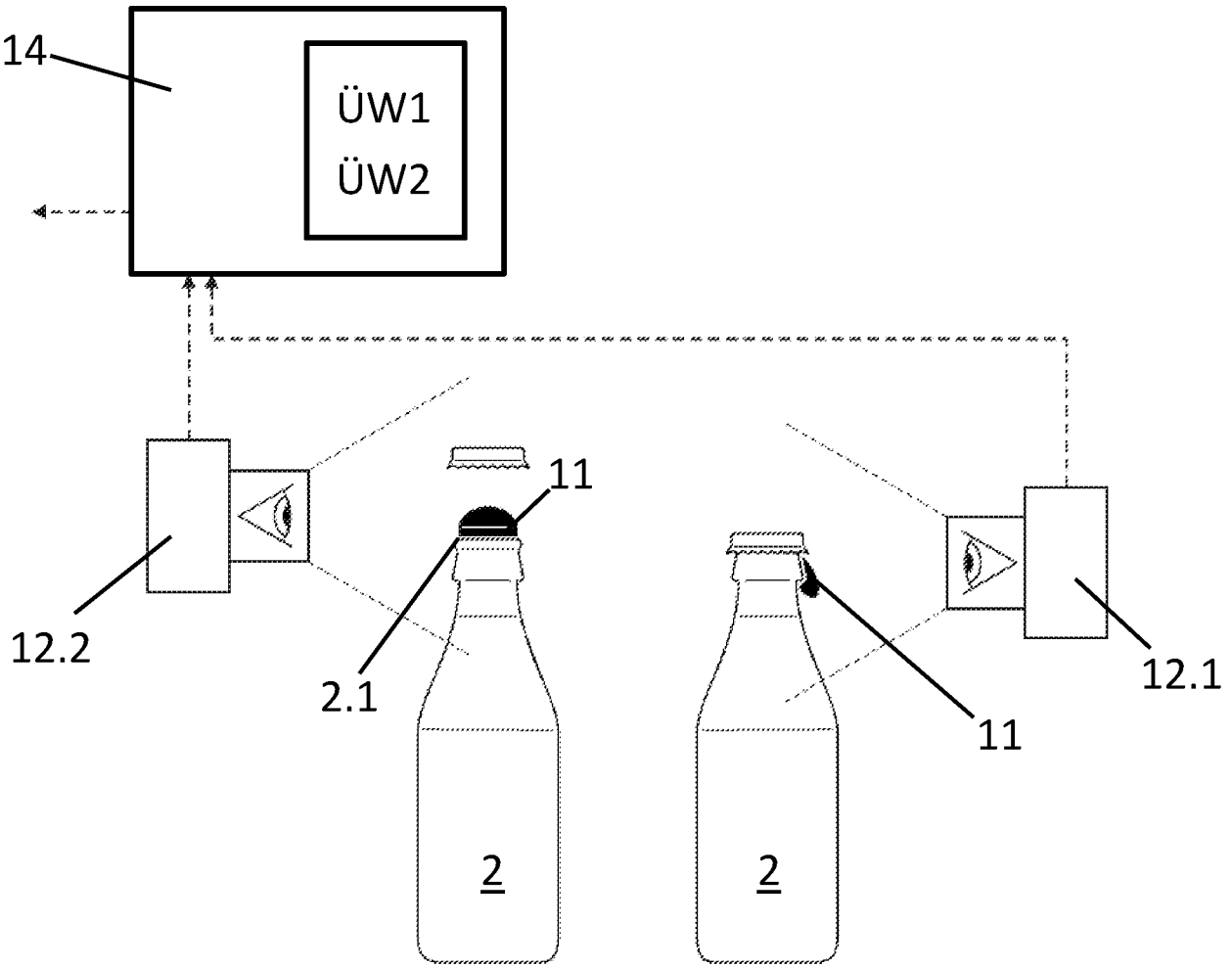
FIG. 3 is a circuit diagram showing an embodiment with two sensors.

FIGS. 2*a*-2*c* show different amounts of foam. Ideally, a small foam nose 11 should be present. FIG. 2*a* shows insufficient foam. FIG. 2*b* shows a small nose of foam 11 emerging slightly above edge of the container's mouth 2.1. FIG. 2*c* shows a foam nose that includes too much foam 11.

Referring back to FIG. 1, the apparatus features first and second sensors 12.1, 12.2, both of which are optoelectronic sensors. A suitable sensor 12.1, 12.2 is a camera. The sensors 12.1, 12.2 are aligned such that the bottle's neck is visible to the sensor 12.1, 12.2.

The first sensor 12.1 is downstream of the closing station 7. The second sensor 12.2 is downstream of the foaming unit 10 and upstream of the closing station 7. Both sensors 12.1, 12.2 provide image data to an image-processing controller 14. Together, the sensors 12.1, 12.2 and the controller 14 define a monitoring system.

The controller 14 monitors foaming and/or fill level based on monitoring criteria UW1, UW2. In some embodiments, the controller 14 is a computer or a computer-supported unit that includes inputs for analog or digital data provided by one or both sensors 12.1, 12.2.

The ejection station 15 ejects those containers 2 for which the foam nose 11 lies outside a target range. The target range is defined by the monitoring criterion UW1. The ejection station 15 does so based on a signal provided by the controller 14. In the illustrated embodiment, ejection takes place after the container 2 has been closed.

In addition to monitoring the extent of the foam 11 and the fill level, the monitoring system also monitors the foam's brightness, color, and/or contrast. As used herein, the "size" refers to the area of that portion of the container's wall that has been wetted by the foam. The size is defined by the foam's length and width. In some embodiments, "size" also includes the foam's thickness.

In some embodiments, the first monitoring criterion UW1 includes target data. In such embodiments, the controller 14 processes image data from a sensor 12.1, 12.2 by comparing it with this target data.

In some cases, the first monitoring criterion UW1 is the foam's permissible extent. This can include its surface area and, in some circumstances, its thickness.

In those embodiments in which the container is on a rotor, it is particularly useful for the sensors 12.1, 12.2 to be placed beyond the rotor's edge. As a result, it is possible to monitor foaming from a convenient location.

The first optoelectrical sensor unit 12.1 provides image data for detecting foam 11 underneath a container's closure and for determining whether the foam's extent exceeds a minimum extent as defined by the first monitoring criterion UW1. Once the foam's extent reaches this target value, in which it covers a minimum surface area on the filled container's outer wall, the residual air or the residual oxygen content in the container 2 lies within the permissible limit values.

The first optoelectrical sensor unit 12.1 and the image-processing and control unit 13 cooperate to determine the foam's spatial extent. If the foam's spatial extent lies below a predetermined minimum size defined by the first monitoring criterion UW1, as is the case for FIG. 2*a*, the controller 13 sends an ejection signal to the ejection station 15, which then proceeds to eject the container 2.

The first monitoring criterion UW1 also defines an upper limit on foam's extent. If the foam's extent lies above this predetermined maximum size defined by the first monitoring criterion UW1, as is the case for FIG. 2*c*, the controller 13 sends an ejection signal to the ejection station 15, which then proceeds to eject the container 2.

In some embodiments, the first monitoring criterion UW1 defines the filling height of liquid filling material in the container 2. The first optoelectrical sensor unit 12.1 provides data for determining the actual filling height in the container 2 and provides that data to the controller.

In other embodiments, the first monitoring criterion UW1 includes allowable values for properties of the foam itself rather than simply its spatial extent. These include the foam's color, the lightness of its formation, and variations in contrast. Embodiments also include those in which the first monitoring criterion UW1 includes allowable values for the surface coverage of the mouth edge, the opening cross-section area of the container mouth 2.1, the color pattern of the edge surface of the bottle mouth, and/or the opening cross-section surface area. All of the foregoing features are monitored by the first optoelectrical sensor unit 12.1.

A preferred foam is one with a small pores and minimal enclosure of air. This type of foam is associated with a lighter color. It is also desirable for foam to have a uniform pore size. This is associated with a low-contrast foam.

In some embodiments, the image-processing and control unit 14 is configured to count ejected containers, to determine the most likely cause of the ejection, and to visually represent the ejected containers 2 to determine whether an over-filling or under-filling of the containers 2 with liquid filling material has been detected. An excessively high ejection rate provides a reason for stopping the filling apparatus so that it can be inspected to identify the cause of the malfunction. Excessively high ejection rates of containers 2 can in this situation lead to a stoppage of the device.

The second sensor 12.2, because of its location, provides away to inspect foam formation prior to closing the container 2. The foam 11 and fill level are evaluated based on a second monitoring criterion.

In some embodiments, the controller 14 controls the foaming unit 10. It does so by controlling the amount of energy carried by the jet 10.1 into the container. The controller 14 varies the amount based on data received from one or both sensors 12.1, 12.2. As a result, the controller 14 carries out feedback regulation of the foaming unit 10.

Like the first sensor 12.1, the second sensor 12.2 provides image data to the controller 14 from which it is possible to evaluate the amount of foam and the nature of the foam, such as its lightness, color, and variations in contrast.

The controller 14 process the image data from the sensors 12.1, 12.2 in part by comparing it with target data stored in the image-processing and control unit 14.

Figure 4B:
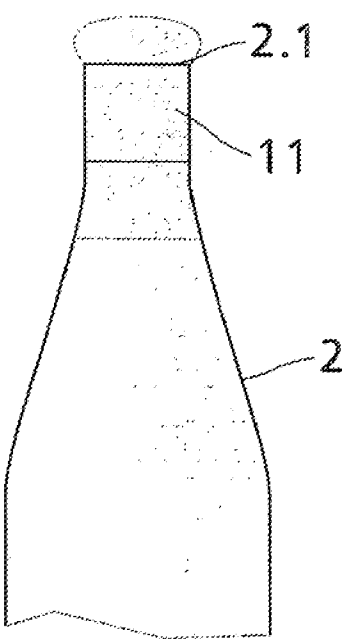
FIGS. 4*a* and 4*b* show inadequate and adequate foam formation based on the second monitoring criterion used in the dual-sensor embodiment of FIG. 3.
Figure 4A:
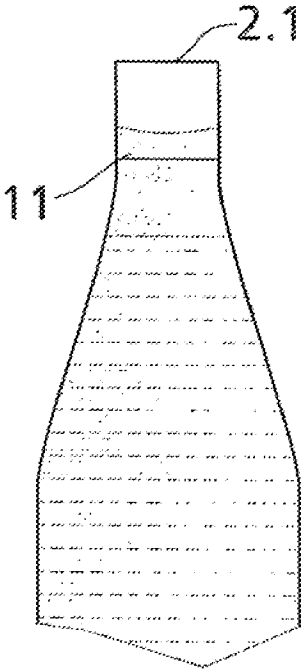

If the parameters associated with the foam 11 are outside a range defined target criteria or parameters of a second monitoring criterion UW2, such as is the case with the foam 11 in FIG. 4*a*, the controller causes the foaming unit 10 to change the energy input of the jet 10.1.

The energy carried by the jet 10.1 depends on the pressure that drives the jet 10.1 and also on the amount of foaming medium being introduced. The controller 14 controls the amount of this energy by increasing it when the images provided by the second sensor 12.1 indicates a high frequency of inadequate foaming and decreasing it when the images indicate a high frequency of excess foaming.

In some embodiments, the second monitoring criterion UW2 is the height of the foam in the respective container 2. Generally, foaming is considered adequate when the foam reaches at least as far as the edge of the container's mouth and preferably projects outward to form a foam crown that protrudes slightly above the edge of the container mouth 2.1. In some practices, excess foam that flows down the container's outer surface is considered excessive. Further monitoring criteria include the foam's color, its lightness, its contrast, the coverage surface area of the mouth edge, the opening cross-section surface area of the bottle mouth, the color pattern of the edge surface of the bottle mouth, and the opening cross-section surface area.

The ejection station 15 is at some distance downstream of the closing station 7. As a result, after having identified a container as one to be ejected, the controller 14 must avoid losing track of it as it makes its way to the ejection station 15. It is therefore useful for the controller 14 to keep count so that when the container to be ejected arrives at the ejection station 15, a suitable ejection signal can be sent. Alternatively, the controller makes use of the known distance to the ejection station 15 and the known speed at which the container moves.

In some embodiments, there exist two foaming units 10 along the transport path. In such embodiments, it is possible for the controller 14 to detect insufficient foaming by the upstream foaming unit and to then instruct the downstream foaming unit to carry out supplemental foaming.

The sensors 12.1, 12.2 need not be cameras. Embodiments include those in which the sensors 12.1, 12.2 take other forms that are suitable for detecting foam formation, and in particular, devices that detect the height of the foam 11 in the container's head space or the height of the height of the foam that projects over the edge of the container's mouths 2.1.

Some embodiments feature a light source that illuminates the container with a spectrum that promotes detection of the relevant features by the sensor units 12.1, 12.2.

The invention has been described heretofore by way of exemplary embodiments. It is understood that a large number of modifications or derivations are possible, without thereby departing from the scope of protection of the invention as defined by the claims.

The invention claimed is:

1. An apparatus for treating containers that have been filled with a foamable liquid, said containers being selected from the group consisting of cans and bottles, wherein said apparatus comprises a transport segment, a foaming unit, a closing station, an ejection unit, and an image-processing control device, said image-processing control device comprising a first sensor and a controller, wherein said containers move along said transport segment in a downstream direction, wherein said containers include an open container that is at said foaming unit and a closed container that has been closed at said closing station, wherein said closing station is downstream of said foaming unit along said transport segment, wherein said ejection unit is downstream of said closing station along said transport segment, wherein said foaming unit is configured to introduce a foaming medium into said open container so as to cause foaming within said open container, wherein said first sensor is an optoelectronic sensor that is downstream of said foaming unit, wherein said first sensor is in data communication with said controller, wherein said image-processing and control device is configured to detect and monitor foam that has emerged from said closed container's mouth after closure thereof and collected on said closed container's outer surface to form a foam nose, and to do so based on a first monitoring criterion, wherein said ejection station is configured to eject said closed container after having received a signal from said controller indicating that said foam nose lies outside a target range specified by said first monitoring criterion, and wherein said controller is configured to control operation of said foaming unit to cause foaming within said open container based on observations of said foam formation at said closed container, wherein said image-processing control device comprises a second sensor, said second sensor being an optoelectronic sensor arranged between said foaming unit and said first sensor, wherein said second sensor and said controller cooperate to monitor and control foam formation of said open container.

2. The apparatus of claim 1, wherein said image-processing and control device is configured to compare said monitoring criterion and said foam nose and to generate an ejection signal in response to determining that said foam nose is outside a range defined by said first monitoring criterion.

3. The apparatus of claim 1, wherein said first monitoring criterion defines an acceptable range of a property of said foam nose.

4. The apparatus of claim 1, wherein said image-processing control system is configured to detect and monitor formation of foam about an opening edge of said closed container's mouth based on a second monitoring criterion.

5. The apparatus of claim 1, wherein said foaming unit directs a jet of said foaming medium into said open container, wherein said image-processing control system is configured to control energy carried by said jet based on having monitored said formation of foam, and wherein said image-process control system is configured to increase said energy upon detecting inadequate foam formation and to decrease said energy upon detecting excessive foam formation.

6. The apparatus of claim 1, wherein said foam nose has a size and wherein first monitoring criterion defines an acceptable range of said foam nose's size.

7. The apparatus of claim 1, wherein said foam nose has a thickness and wherein first monitoring criterion defines an acceptable range of said foam nose's thickness.

8. The apparatus of claim 1, wherein said controller is configured to evaluate said foam nose based on lightness of said foam.

9. The apparatus of claim 1, wherein said controller is configured to evaluate said foam nose based on color of said foam.

10. The apparatus of claim 1, wherein said controller is configured to evaluate said foam nose based on variations of contrast within said foam.

11. The apparatus of claim 1, wherein said controller is configured to process image data representative of said foam nose by comparing said data with stored target data.

12. The apparatus of claim 1, wherein said foaming unit is an upstream foaming unit and said apparatus further comprises a downstream foaming unit, wherein, in response to detecting inadequate foaming by said upstream foaming unit, said controller provides a signal to said downstream foaming unit to carry out supplemental foaming.

13. The apparatus of claim 1, further comprising a light source that outputs a spectrum of light selected to promote detection of said foam nose.

14. A method specially adapted for treating a containers that have been filled with a foamable liquid, said containers being selected from the group consisting of cans and bottles, and doing so using an apparatus that comprises a transport segment, a foaming unit configured to introduce a foaming medium into an open container so as to cause foaming within said open container, a closing station for closing said open container, thereby transforming said open container into a closed container, an ejection unit, an optoelectronic sensor, and a controller in data communication with said sensor, said method comprising moving first and second containers along said transport direction in a downstream direction, filling said first container with liquid, using said foaming unit, introducing a foaming medium into said first container so as to cause foaming within said first container, closing said first container, after having closed said first container, causing said sensor and said controller to detect and monitor a foam nose that has emerged from a mouth edge of said first container's mouth and has collected on said first container's outer surface and to do so based on a monitoring criterion, ands using said controller, controlling operation of said foaming unit while introducing a foaming medium into said second container so as to cause foaming in said second container, wherein controlling operation is based on observation of a foam nose that has formed on an outer surface of said first container after said first container has been closed, wherein using said controller comprises, at said controller, determining that said foam nose lies outside a target range specified by said first monitoring criterion and transmitting an ejection signal to said ejection station, and at said ejection station, responding to said ejection signal by ejecting said first container, further using a second sensor to detect and monitor foam formation between said foaming unit and said first sensor and prior to closing of said first container, said second sensor being an optoelectronic sensor, wherein said foam formation is monitored according to a second monitoring criterion and wherein said method further comprises causing said foaming unit to direct a jet of foaming medium into said second container, said jet carrying energy that is selected based on an extent of said foam formation in said first container.

15. The method of claim 14, wherein using said second sensor to detect and monitor said foam formation comprises using said second sensor to detect and monitor the foam formation above an opening edge of said first container's mouth and according to a second monitoring criterion.

16. The method of claim 14, wherein said jet carries a first energy, said method further comprising determining that said foam formation in a population of containers that includes said first container is inadequate and causing said jet to carry a second energy while introducing said foaming medium into said second container, said second energy being greater than said first energy.

17. The method of claim 14, wherein said jet carries a first energy, said method further comprising determining that said foam formation in a population of containers that includes said first container is excessive and causing said jet to carry a second energy while introducing said foaming medium into said second container, said second energy being less than said first energy.

18. The method of claim 14, further comprising selecting said foaming medium to have uniform pore size.

* * * * *